US010566700B2

(12) United States Patent
Brandau

(10) Patent No.: US 10,566,700 B2
(45) **Date of Patent: *Feb. 18, 2020**

(54) SUB-REFLECTOR ASSEMBLY WITH EXTENDED DIELECTRIC RADIATOR

(71) Applicant: CommScope Technologies LLC, Hickory, NC (US)

(72) Inventor: Ronald J. Brandau, Homer Glen, IL (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/804,063

(22) Filed: Nov. 6, 2017

(65) Prior Publication Data

US 2018/0115085 A1 Apr. 26, 2018

Related U.S. Application Data

(62) Division of application No. 14/279,408, filed on May 16, 2014, now Pat. No. 9,831,563.

(Continued)

(51) Int. Cl.
*H01Q 13/00* (2006.01)
*H01Q 19/18* (2006.01)

(Continued)

(52) U.S. Cl.
CPC ..... *H01Q 19/18* (2013.01); *H01Q 19/134* (2013.01); *H01Q 19/193* (2013.01)

(58) Field of Classification Search
CPC ..... H01Q 19/13; H01Q 19/17; H01Q 15/248; H01Q 19/193

(Continued)

(56) References Cited

U.S. PATENT DOCUMENTS 4,963,878 A 10/1990 Kildal
6,137,449 A * 10/2000 Kildal ..... H01Q 1/42 343/781 CA (Continued)

FOREIGN PATENT DOCUMENTS

| | | |
|---|---|---|
| EP | 2615691 | 7/2013 |
| GB | 1531242 | 11/1978 |
| WO | WO2013032556 | 3/2013 |

OTHER PUBLICATIONS

International Search Report and Written Opinion, dated Oct. 29, 2014 for the corresponding PCT Application No. PCT/US2014/048762.

(Continued)

*Primary Examiner* — Dameon E Levi
*Assistant Examiner* — Collin Dawkins
(74) *Attorney, Agent, or Firm* — Myers Bigel, P.A.

(57) ABSTRACT

In one embodiment, a sub-reflector assembly for a reflector antenna has (i) a waveguide transition at a waveguide end of the sub-reflector assembly and configured to fit within a waveguide, (ii) a dielectric radiator connected to the waveguide transition and extending both laterally and back towards the waveguide end of the sub-reflector assembly, and (iii) a sub-reflector connected to the dielectric radiator. By configuring the dielectric radiator to extend both laterally and back towards the dielectric end of the assembly, radiated energy from the waveguide is directed such that the sub-reflector assembly can be used with shallow reflector dishes (e.g., F/D ratio greater than 0.25) and still achieve sufficiently high directivity.

1 Claim, 5 Drawing Sheets

Related U.S. Application Data

(60) Provisional application No. 61/864,760, filed on Aug. 12, 2013.

(51) Int. Cl.
*H01Q 19/13* (2006.01)
*H01Q 19/19* (2006.01)

(58) Field of Classification Search
USPC ..... 343/781, 781 P, 781 R, 781 CA, 779, 343/761, 786, 840
See application file for complete search history.

(56) References Cited

U.S. PATENT DOCUMENTS 6,919,855 B2 7/2005 Hills
2003/0184486 A1* 10/2003 Shafai ..... H01Q 19/134 343/779
2005/0007288 A1 1/2005 Tuau
2005/0062663 A1* 3/2005 Hills ..... H01Q 13/0216 343/781 P
2013/0057445 A1 3/2013 Simms

OTHER PUBLICATIONS

Chane, M.H., et al., "A Compact EHF/SHF Dual Frequency Antenna," Institute of Electrical and Electronics Engineers, Dallas, TX May 1990, IEEE, vol. 4, pp. 1526-1529.
Newham, P., "A High Efficiency Splashplate Feed," IEEE Second International Conference on Antennas and Propagation, Apr. 13-16, 1981, pp. 354-357.

* cited by examiner

SUB-REFLECTOR ASSEMBLY WITH EXTENDED DIELECTRIC RADIATOR

CROSS-REFERENCE TO RELATED APPLICATIONS

This application is a division of U.S. patent application Ser. No. 14/279,408, filed May 16, 2014, which claims priority to U.S. Provisional Patent Application No. 61/864,760, filed on Aug. 12, 2013, and titled "Sub-Reflector Assembly with Extended Dielectric Radiator" the disclosures of which are incorporated herein by reference in their entireties.

BACKGROUND

Field of the Invention

This invention relates to a reflector antenna. More particularly, the invention provides a low-cost, self-supported sub-reflector assembly configured to provide a reflector antenna with a low side-lobe signal radiation pattern characteristic.

Description of the Related Art

This section introduces aspects that may help facilitate a better understanding of the invention. Accordingly, the statements of this section are to be read in this light and are not to be understood as admissions about what is prior art or what is not prior art.

An example of a dielectric cone feed sub-reflector configured for use with a deep-dish reflector is disclosed in commonly owned U.S. Pat. No. 6,919,855 ("the '855 patent"), the teachings of which are incorporated herein by reference in their entirety. The '855 patent utilizes a dielectric block cone feed with a sub-reflector surface and a leading cone surface having a plurality of downward angled non-periodic perturbations concentric about a longitudinal axis of the dielectric block. The cone feed and sub-reflector diameters are minimized where possible, to prevent blockage of the signal path from the reflector dish to free space. Although a significant improvement over prior designs, such configurations have signal patterns in which the sub-reflector edge and distal edge of the feed boom radiate a portion of the signal broadly across the reflector dish surface, including areas proximate the reflector dish periphery and/or a shadow area of the sub-reflector where secondary reflections with the feed boom and/or sub-reflector may be generated, degrading electrical performance.

Dielectric block-type sub-reflector supports with dielectric radiator structures are also known. Laterally projecting dielectric radiator structures separate from sub-reflector support portions of the dielectric block have been shown to enhance signal patterns by drawing the energy field distribution away from the waveguide supporting the dielectric block. This form of dielectric block sub-reflector has previously been applied to deep-dish-type main reflectors, for example with a focal length (F) to diameter (D) ratio of 0.25 or less.

BRIEF DESCRIPTION OF THE DRAWINGS

Other embodiments of the invention will become more fully apparent from the following detailed description, the appended claims, and the accompanying drawings in which like reference numerals identify similar or identical elements.

DETAILED DESCRIPTION

The inventor has recognized that dielectric radiator technology may be applied to dielectric sub-reflector supports of reflector antennas with reflector dishes with higher F/D ratios (e.g., shallow-dish (F/D ratio greater than 0.25) rather than deep-dish reflectors (F/D ratio less than or equal to 0.25)), by extending the laterally projecting dielectric radiator back towards the waveguide end of the sub-reflector.

Figure 1:
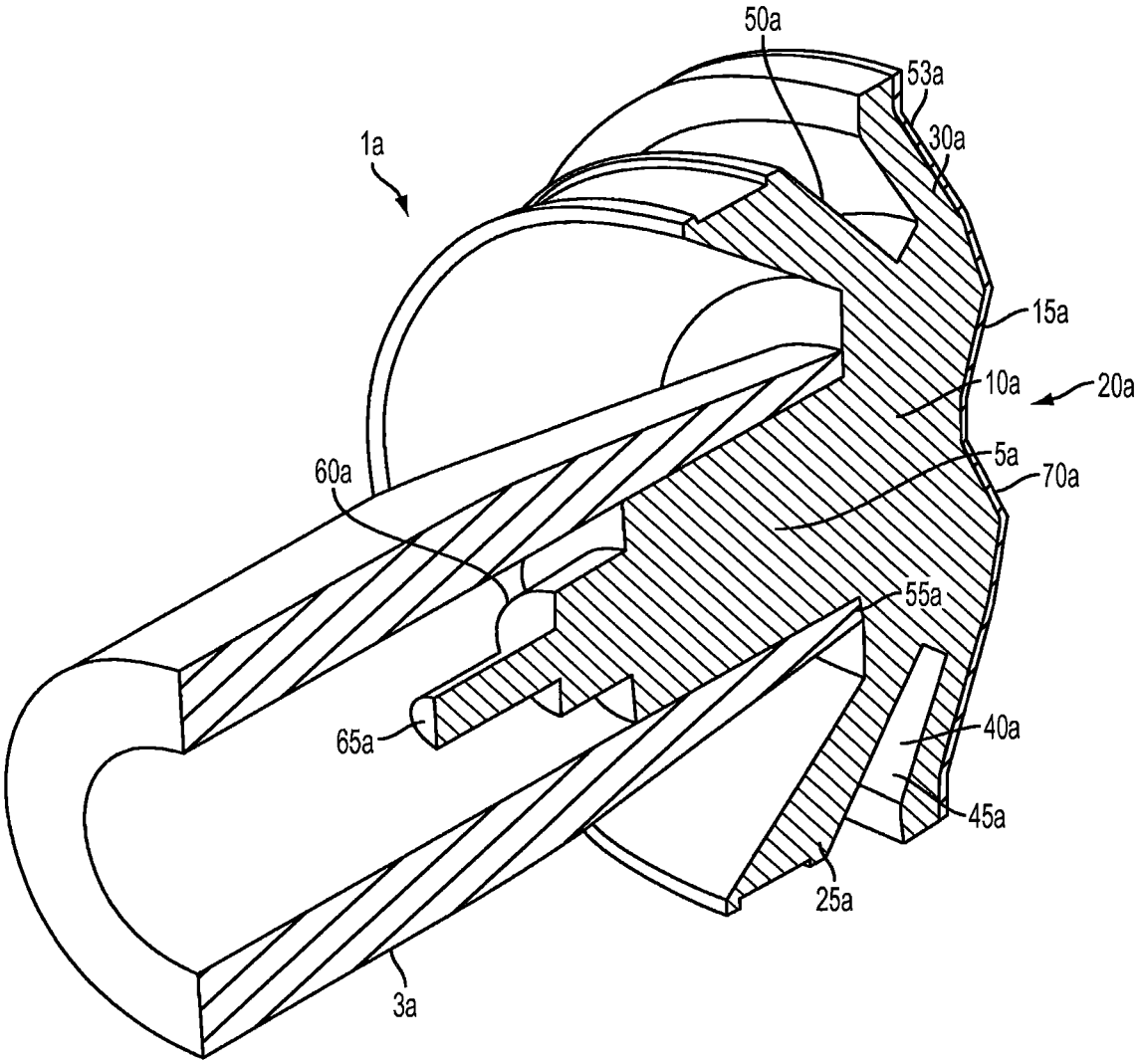
FIG. 1 is a schematic cut-away isometric view of an exemplary sub-reflector assembly.
Figure 2:
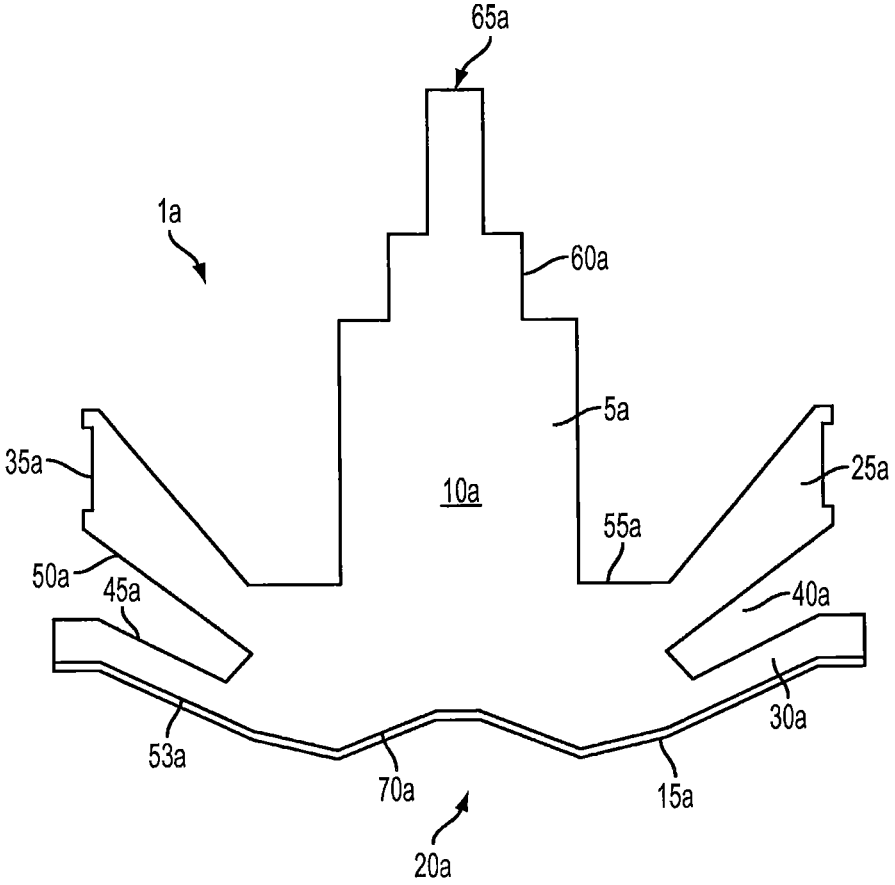
FIG. 2 is a schematic cut-away side view of the dielectric radiator and sub-reflector of FIG. 1.

As shown in FIGS. 1 and 2, an exemplary cone radiator sub-reflector assembly 1*a* is configured to couple with a distal end of a feed waveguide 3*a* at a waveguide transition portion 5*a* of a unitary dielectric block (i.e., radiator) 10*a* which supports a sub-reflector 15*a* at the distal end 20*a*. The feed waveguide 3*a* extends from the reflector dish (not shown), positioning the sub-reflector 15*a* proximate a focal point of the reflector dish. The waveguide 3*a* is demonstrated with a tapered end as the embodiments disclosed are dimensioned for operation at 86 GHz, where the wavelength approaches a size where the typical waveguide tube sidewall thickness becomes significant. Other waveguide geometries may be suitable for other applications.

A dielectric radiator portion 25*a* situated between the waveguide transition portion 5*a* and a sub-reflector support portion 30*a* of the dielectric radiator 10*a* is provided extending laterally and also back towards the waveguide end 65*a* of the sub-reflector assembly 1. The enlarged dielectric radiator portion 25*a* is operative to pull signal energy outward from the end of the waveguide 3*a*, thus minimizing the diffraction at this area observed in conventional dielectric cone sub-reflector configurations. The dielectric radiator portion 25*a* has a shoulder 55*a* that extends laterally from the end of the waveguide 3*a*, without contacting outer diameter surfaces of the waveguide 3*a*. Thereby, surface currents around and down the outer surface of the waveguide 3*a* may be inhibited.

Grooves 35*a* and/or annular projections may be provided along the outer diameter of the dielectric radiator portion 25*a*. The grooves and/or annular projections may have a cylindrical outer diameter.

An angled distal groove 40*a* is provided with (i) a proximal sidewall 50*a* defining a distal end of the dielectric radiator portion 25*a* and (ii) a distal sidewall 45*a* that initiates a sub-reflector support portion 30*a* which supports a peripheral surface 53*a* of the sub-reflector 15*a*. The distal sidewall 45*a* may be generally parallel to a longitudinally adjacent portion of the distal end 20*a*; that is, the distal sidewall 45*a* may form a conical surface parallel to the longitudinally adjacent peripheral surface 53*a* of the distal end 20*a* supporting the sub-reflector 15*a*, so that a dielectric thickness along the peripheral surface 53*a* is substantially constant.

The waveguide transition portion 5*a* of the sub-reflector assembly 1*a* may be adapted to match a desired circular waveguide internal diameter so that the sub-reflector assembly 1*a* may be fitted into and retained by the waveguide 3*a* that supports the sub-reflector assembly 1*a* within the dish reflector of the reflector antenna proximate a focal point of the dish reflector. The waveguide transition portion 5*a* may insert into the waveguide 3*a* until the end of the waveguide 3*a* abuts the shoulder 55*a* of the waveguide transition portion 5*a*.

One or more step(s) 60*a* at the waveguide end 65*a* of the waveguide transition portion 5*a* and/or one or more groove(s) may be used for impedance matching purposes between the waveguide 3*a* and the dielectric material of the dielectric radiator 10*a*.

The sub-reflector 15*a* is demonstrated with a reflector surface 70*a* and a peripheral surface 53*a* which extends laterally to inhibit spill-over.

Figure 3:
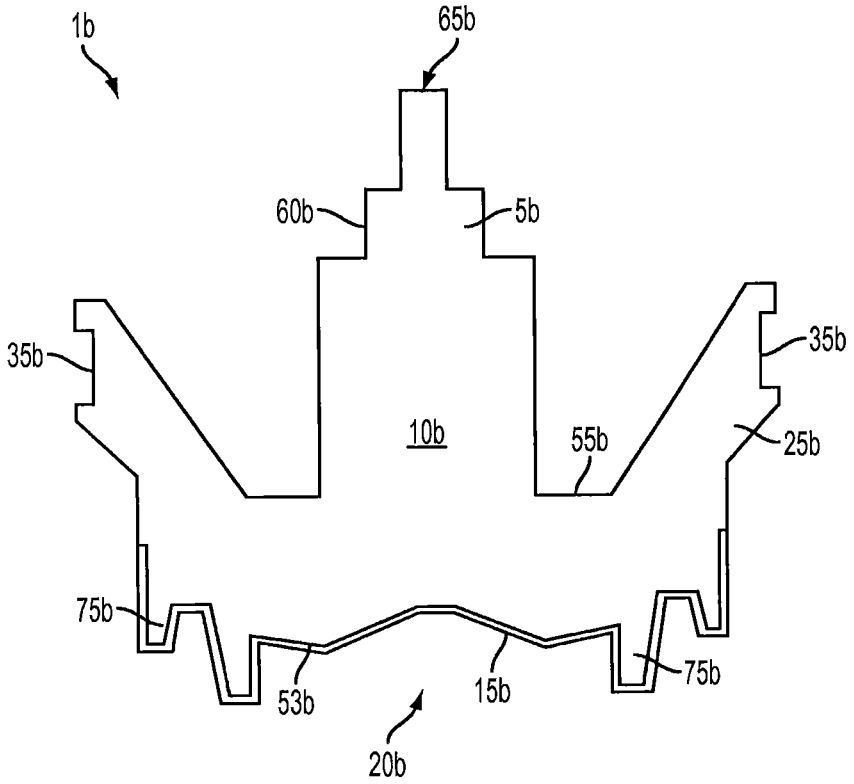
FIG. 3 is a schematic cut-away side view of a dielectric radiator and sub-reflector, demonstrating application of dielectric-filled chokes at the sub-reflector periphery.

In alternative embodiments, for example as shown in FIG. 3, the peripheral surface 53*b* may be provided with annular chokes 75*b* to reduce spill-over at the sub-reflector 15*b* periphery. The chokes 75*b* may be dimensioned, for example, as ¼ wavelength of the desired operating frequency. The chokes may enable a reduction of the sub-reflector 15*b* and peripheral surface 53*b* overall diameter, resulting in the radiator portion 25*b* projecting outboard of the sub-reflector 15*b* and the outer diameter of the peripheral surface 53*b*. The sub-reflector 15*b* may be formed by applying a metallic deposition, film, sheet, or other RF reflective coating to the distal end 20*b* of the dielectric radiator 10*b*.

Figure 4:
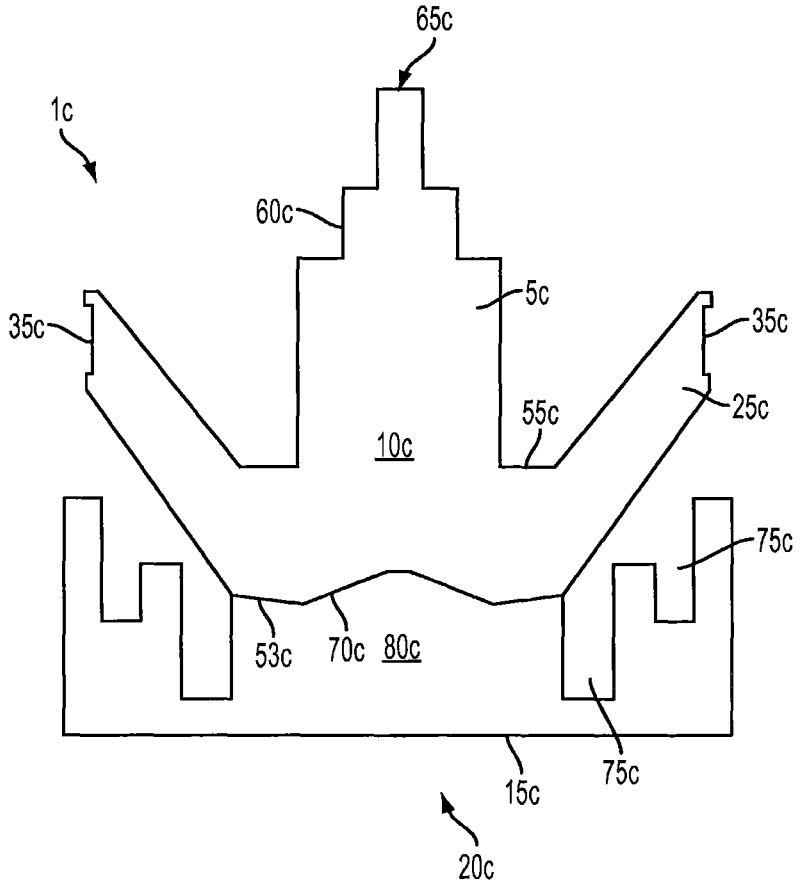
FIG. 4 is a schematic cut-away side view of a dielectric radiator and separate sub-reflector.
Figure 5:
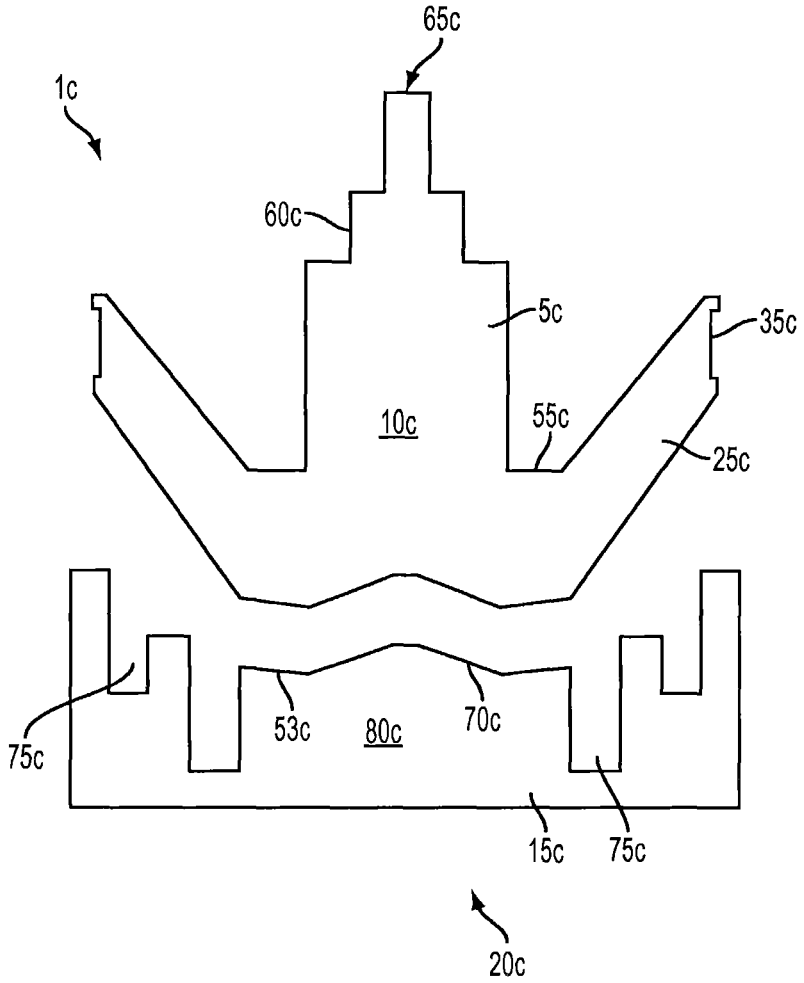
FIG. 5 is a schematic exploded cut-away side view of the dielectric radiator and separate sub-reflector of FIG. 4.

Alternatively, as shown for example in FIGS. 4 and 5, the sub-reflector 15*c* may be formed separately, for example as a metal disk 80*c* which seats upon the distal end 20*c* of the dielectric radiator 10*c*. Since the periphery of the metal disk 80*c* may be configured to be thick enough to be self supporting, a sub-reflector support portion analogous to portion 30*a* of FIGS. 1 and 2 which extends to the outer diameter of the peripheral surface 53*c* might not be required, simplifying the configuration of the dielectric radiator 10*c*. Note that sub-reflector 15*c* has two air-filled, annular chokes 75*c*, while sub-reflector 15*b* has two dielectric-filled chokes 75*b*. Other embodiments may have more or fewer chokes.

In each of these different embodiments, the radiation pattern is directed primarily towards a mid-section area of the dish reflector spaced away both from the sub-reflector shadow area and the periphery of the dish reflector. By applying a dielectric radiator portion 25 extending back towards the waveguide end 65 of the sub-reflector assembly 1 and behind the distal end of the waveguide 3, a broad radiation pattern complementary with shallower F/D dish reflectors is obtained, with the projection of the majority of the radiation pattern at an increased outward angle, rather than back towards the area shadowed by the sub-reflector assembly 1, which allows the radiation pattern to impact the mid-section of the dish reflector while reducing illumination intensity at either edge of the desired areas.

One skilled in the art will appreciate that the dielectric radiator portion configurations disclosed enable radiation patterns to be tuned for shallower F/D reflectors, while still avoiding electrical performance degradation resulting from waveguide end diffraction and/or reflector dish or sub-reflector spill-over.

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

Unless explicitly stated otherwise, each numerical value and range should be interpreted as being approximate as if the word "about" or "approximately" preceded the value or range.

It will be further understood that various changes in the details, materials, and arrangements of the parts which have been described and illustrated in order to explain embodiments of this invention may be made by those skilled in the art without departing from embodiments of the invention encompassed by the following claims.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

The invention claimed is:

1. A sub-reflector assembly for a reflector antenna, the sub-reflector assembly comprising:

a waveguide transition at a waveguide end of the sub-reflector assembly and configured to fit within a distal end of a waveguide, which extends along a longitudinal axis of the sub-reflector assembly;

a dielectric radiator connected to the waveguide transition; and a sub-reflector on the dielectric radiator, opposite the waveguide transition, said sub-reflector comprising a metal disk distinct from the dielectric radiator, said metal disk comprising one or more air-filled, annular chokes defined therein that face the dielectric radiator;

wherein a diameter of an outermost portion of the dielectric radiator relative to the longitudinal axis is greater than an outermost diameter of at least one of the one or more air-filled, annular chokes within said metal disk;

wherein open ends of the air-filled, annular chokes face a proximal sidewall of the dielectric radiator; and wherein at least one open end of the one or more air-filled, annular chokes is spaced-apart from the proximal sidewall of the dielectric radiator so that no direct contact is provided between the at least one open end of the one or more air-filled, annular chokes, and the dielectric radiator.

* * * * *